United States Patent [19]

Saito et al.

[11] Patent Number: 4,516,727

[45] Date of Patent: May 14, 1985

[54] MANUALLY-OPERATED SPRAYER

[75] Inventors: Tadao Saito; Takao Kishi; Yoshiyuki Kakuta, all of Tokyo, Japan

[73] Assignee: Yoshino Kogyosho Co., Ltd., Japan

[21] Appl. No.: 498,508

[22] Filed: May 26, 1983

[51] Int. Cl.[3] ..... B05B 9/043

[52] U.S. Cl. ..... 239/333; 239/369; 222/321

[58] Field of Search ..... 222/321, 108–110; 239/106, 337, 333, 331, 369, 371

[56] References Cited

U.S. PATENT DOCUMENTS 4,017,031 4/1977 Kishi et al. ..... 239/333

4,277,001 7/1981 Nozawa ..... 239/333

4,305,530 12/1981 Nozawa ..... 239/333

4,365,729 12/1982 Saito et al. ..... 239/333

*Primary Examiner*—H. Grant Skaggs

*Attorney, Agent, or Firm*—Parkhurst & Oliff

[57] ABSTRACT

A mechanism wherein an air cylinder plunger which can move within the air cylinder is provided within a manually-operated sprayer. The air cylinder plunger compresses the space within the air cylinder in accordance with the spraying operation of sprayer pump of a manually-controlled sprayer and discharges the air into the liquid to be sent to the nozzle hole. The external air is sucked into the air cylinder through the nozzle in accordance with the liquid sucking operation of the sprayer pump.

4 Claims, 1 Drawing Figure

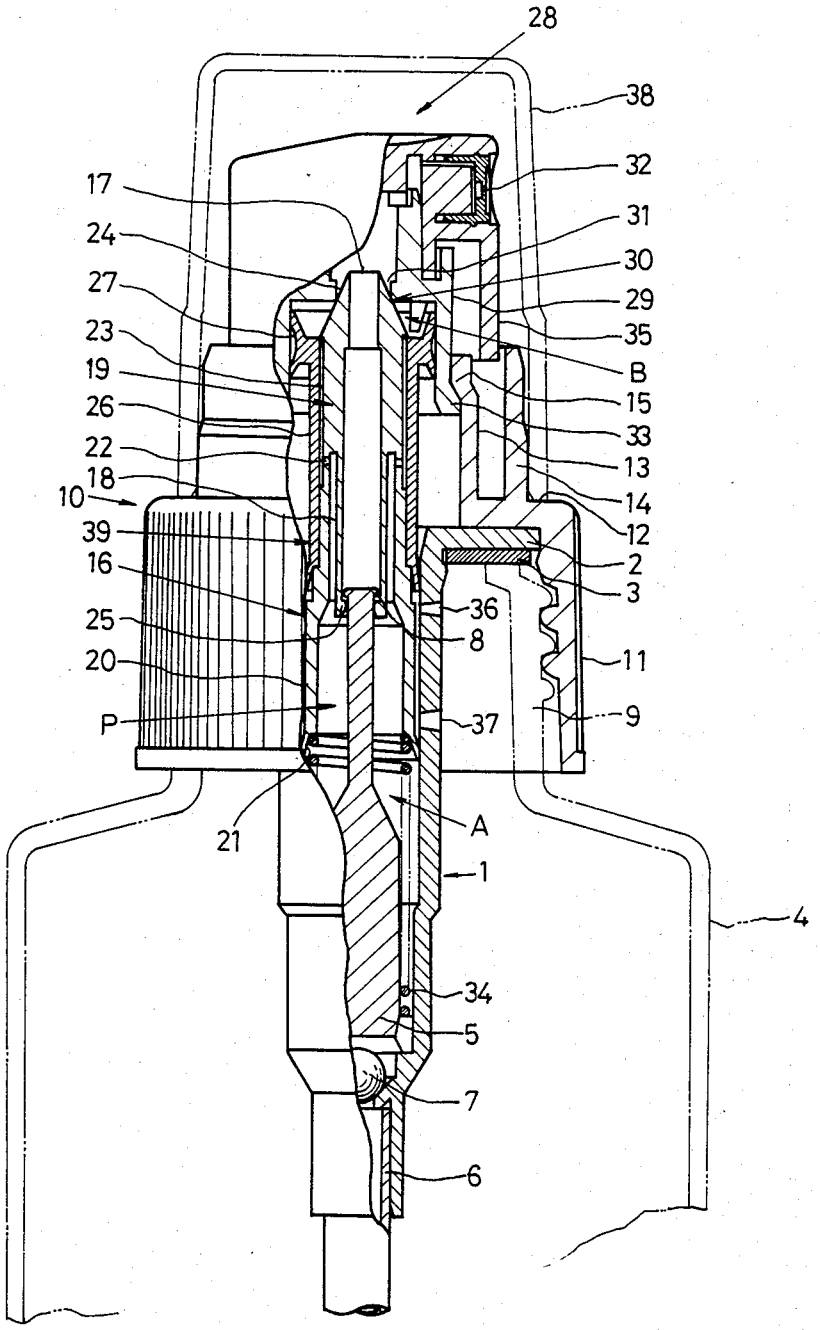
28
38
32
31
30
29
35
B
15
33
13
14
12
2
3
11
9
17
24
27
23
19
26
22
18
10
39
16
25
20
P
21
36
8
37
A
1
4
34
5
7
6

MANUALLY-OPERATED SPRAYER

FIELD OF THE INVENTION

The present invention relates to a manually-operated sprayer comprising an air cylinder for discharging air to the nozzle hole.

DESCRIPTION OF THE PRIOR ARTS

A manually-operated sprayer is used in diversified application fields and, in the case of spraying liquid dissolving chemicals, for example, the mist particle size must be as fine as possible. However, when a chemical is dissolved in the liquid to be sprayed, the dissolved substance may hardened when it is dried, resulting in choking of nozzle hole. In particular, liquid adheres to the inner wall of nozzle hole because of use of the sprayer, the substance dissolved in the liquid is deposited at the inner wall of nozzle hole when such adhered liquid dries and the deposited substance accumulates through repeated use of sprayer, until the substance finally chokes the nozzle hole.

OBJECTS OF THE INVENTION

A first object of the present invention is to generate fine mist particles from a nozzle hole by discharging air thereto from the inside of the sprayer simultaneously with the spraying operation.

A second object of the present invention is to blow away any liquid adhering to the nozzle hole by sucking external air therethrough, thereby preventing choking of the nozzle hole.

BRIEF DESCRIPTION OF THE DRAWINGS

The attached drawing is a vertical cross section of a manually-operated sprayer according to the present invention.

DETAILED DESCRIPTION OF THE INVENTION

A manually-operated sprayer of the present invention will be explained hereunder. A small-diameter cylinder 1 of a manually-operated sprayer is mounted vertically within a container 4, and a flange 2 provided extending outwardly at the upper part of said small-diameter cylinder 1 is placed on the top surface of the container 4 through the packing 3. In said small-diameter cylinder 1, an air cylinder plunger 5 the upper half of which has a reduced diameter is disposed coaxially, such that a desired number of foot pieces provided at the circumference of the lower end of said plunger 5 are disposed adjacent to the upwardly directed step formed at the circumference of the bottom part of the small-diameter cylinder 1. Said plunger 5 is provided with a release stop projection 8 at its upper end. From the bottom part of the small-diameter cylinder 1, a suction tube 6 extends vertically to the bottom of the container 4 through the suction valve 7. An external air suction hole 36 is bored at the upper part of the small-diameter cylilnder 1 and a hole 37 for releasing high pressure within the pump chamber P also is bored lower on the cylinder 1.

A mounting member 10 and its circumferential wall 11 engage the neck part 9 of the container 4. An inward flange 12 at the upper end of circumferential wall 11 and the top surface of container 4 hold the outward flange 2 of the small-diameter cylinder 1 from both sides through the packing 3. The inner engaging cylinder 13 providing the engaging passage 15 at its inner side extends from the inner circumference of the inward flange 12, while the outer engaging cylinder 14 extends from the upper surface of an intermediate part of the inward flange 12.

The lower part of a cylindrical plunger 39 is slidably engaged within the small-diameter cylinder 1 for vertical movement therein. The cylindrical plunger 39 comprises an outer cylinder. 26 engaged with the outer surface of a movable cylinder member 16, the cylindrical plunger 39 being biased upwardly by a spring 34 provided within the small-diameter cylinder 1. The lower portion of the movable cylinder member 16 is formed as a double-walled cylinder, with the outer cylinder 20 longer than the inner cylinder 18. The external circumference of the lower end of the outer cylinder 20 is formed as a cylindrical piston 21 and is placed closely in contact with the inner wall of the small-diameter cylinder 1. The internal circumference at the lower end of the inner cylinder 18 is provided with the engaging passage 25. The upper part of said air cylinder plunger 5 is vertically and slidably engaged in a watertight fashion within said inner cylinder 18. Engagement between the engaging passage 25 and the release stop projection 8 of the air cylinder plunger 5 prevents release of said cylindrical plunger 39. The upper cylinder part of the movable cylinder member 16 and the inner cylinder 18 form an air cylinder 19 with an aperture 17 provided at its upper end. The internal space of the outer cylinder 20 located below the inner cylinder and the internal space of the small-diameter cylinder 1 located below the outer cylinder 20 form the pressure chamber A. Both inner and outer cylinders 18, 20 are separated through a clearance. The through holes 22 are bored at the upper part of the outer cylinder 20 and the vertical grooves 23 are provided extending upwardly along the external surface of the movable cylinder member 16 from the external aperture of said through holes 22. The upper end part of the movable cylinder member 16 is formed as a tapered discharge valve body 24. The external surface at the upper end of the outer cylinder 26 is provided with a large-diameter piston 27, with the upper end of said vertical groove 23 opening at the external surface and upper region of the large-diameter piston 27. At the circumference of the lower end of outer cylinder 20, the cylindrical piston 21 is also provided, said piston extending beyond the lower end of the outer cylinder 26.

A side of the upper part of a spray head 28 is bored with the nozzle hole 32 and the center of its lower part is bored with the discharge valve hole 31, connected to said nozzle hole 32 through the discharge passage. A large-diameter cylinder 29 which is larger in diameter than said small-diameter cylinder extends vertically from the spray head 28 Said large-diameter cylinder 29 movably vertically engages the internal surface of the inner engaging cylinder 13 of said mounting member 10. Engagement between an engaging projection 33 provided on the external circumference of the lower end of said large-diameter cylinder 29 and the engaging passage 15 of inner engaging cylinder 13 prevents release of the large-diameter cylinder 29. A guide cylinder 35 extends vertically from the external circumference of the spray head 28 and is formed such that it can move downward between the outer and inner engaging cylinders 13 and 14 of the mounting member 10. The discharge valve 30 is formed by said discharge valve hole 31 and discharge valve body 24. A pressure chamber B is formed by the space between the large-diameter cylinder 29, the upper part of large-diameter piston extends vertically from the spray head 28. Said pressure chamber B and said chamber A are interconnected through the vertical groove 23, the hole 22, and the clearance between the inner and outer cylinders 19, 20, and all of these form the pump chamber P.

The spray head 28 is covered with a cap 38, which is engaged removably with the outer engaging cylinder 14 of the mounting member 10.

The functions of the above-explained structure will now be explained. For convenience of explanation, it is supposed that the liquid within the container 4 is already sucked into the pressure chamber A. In this state, if the spray head 28 is pressed downward against the spring 34, the cylindrical plunger 39 is also pressed downward together with the spray head 28, so that the discharge valve 30 remains closed, thereby compressing the inside space of the pressure chamber A. Thus, the pressure within the pressure chamber A is built up simultaneously with that in the pressure chamber B. Then, the cylindrical plunger 39 goes further downward with the spray head 28 owing to the diameter difference between the large- and small-diameter cylinders 29, 1. This causes the discharge valve 30 to open and accordingly the liquid in the pump chamber P is sprayed out from the nozzle hole 32 passing the discharge valve hole 31. On the other hand, the downward movement of cylindrical plunger 39 effectuated when the spray head 28 is pressed downward compresses the inside space of the chamber of air cylinder 19 because the plunger 5 for the air cylinder 19 enters the air cylinder 19. When the air in the cylinder chamber is pressurized, said air passes the aperture 17 at the upper end, the discharge hole 31 and is sprayed out together with said liquid. This discharged air is mixed with the spray liquid and thereby finer mist particles of spray liquid can be obtained.

When depression of spray head 28 stops, the exhaust valve 30 closes, the cylindrical plunger 39 and spray head 28 are pushed upward by the effect of spring 34 due to the release of the spray head 28. Thereby, the spray head returns to the indicated condition. On the occasion of such recovery of spray head, the pump chamber P is negatively pressurized and therefore the suction valve 7 opens and the liquid in the container is sucked into the pump chamber through the suction tube 6. On the other hand, since the air cylinder plunger 5 returns to the condition indicated, the air cylinder chamber 19 is also negatively pressurized. Accordingly, the external air is sucked into the air cylinder chamber through the nozzle hole 32, discharge valve hole 31 and aperture 17 at the upper end, and the liquid adhering to the inside wall of nozzle hole 32 is also sucked into the discharge valve hole 31.

The present invention discloses the aforementioned structure wherein the air sucking and exhausting mechanism consisting of the air cylinder chamber and plunger for air cylinder is provided so that the air is mixed with the liquid prior to spraying operation by depression of the spray head, so that finer mist particles can be obtained. Moreover, since external air is sucked into the air cylinder chamber through the nozzle hole when the liquid is sucked into the small-diameter cylinder by ascent of the spray head, the liquid adhering to the internal wall of the nozzle hole can also be sucked in by such inflow of air. Accordingly, choking of the nozzle hole when the liquid adhering to the nozzle hole dries up can be prevented.

What is claimed is:

1. A manually-operated sprayer comprising:

a container for liquid;

a first lower cylinder depending into the container and inserted into the same;

a suction valve disposed at the bottom portion of the first lower cylinder;

a mounting member engaged with the neck portion of the container;

a spray head elevationally movably associated with an upper portion of the mounting member, said spray head including a nozzle hole and a discharge valve hole communicating with said nozzle hole;

a movable member having its upper end portion formed as a discharge valve body;

a cylindrical plunger fixed to the outer surface of the movable member, said cylindrical plunger including a first piston formed at a lower end portion thereof and a second piston formed at an upper end portion thereof, said first piston being slidably received by an inner surface of the first lower cylinder, and said second piston having a larger diameter than said first piston;

a second upper cylinder formed within the spray head in axial alignment with the first lower cylinder, said second upper cylinder having a larger diameter than the first lower cylinder and receiving in a slidable manner the second piston of the cylindrical plunger;

a spring upwardly biasing the movable member and the cylindrical plunger;

a discharge valve comprising the discharge valve body and the discharge valve hole; and a pump chamber comprising the internal spaces of said first and second cylinders and a passage communicating between both of said cylinders;

whereby, when the pressure in the pump chamber is increased by a pumping action, the movable member and the cylindrical plunger are moved down against the biasing force of the spring so that the discharge valve is opened thereby to atomize the liquid out of the nozzle hole;

an air cylinder formed inside the movable member and communicating with the nozzle hole through an opening axially perforated in the upper end portion of the movable member; and an air cylinder plunger provided within the first lower cylinder and having its upper end portion slidably received by the inner surface of said air cylinder, whereby when the spray head is moved down to depress the pump chamber, air is blown out from the air cylinder to the nozzle hole and mixed with the pressurized liquid from the pump chamber, and, when the spray head is moved up to expand the pump chamber, external air is sucked into the air cylinder through the nozzle hole.

2. The manually-operated sprayer of claim 1, wherein said movable member has at the lower half portion thereof an outer cylinder wall, an inner cylinder wall, and a passage therebetween, said outer cylinder wall extending axially downwardly beyond the lowermost end of said inner cylinder wall and having its lower end portion formed as a piston slidably received by the inner surface of the first lower cylinder, said inner cylinder wall forming the air cylinder at a location below the discharge valve body, and said passage communicating with the second upper cylinder through a hole radially perforated in the outer cylinder wall.

3. The manually-operated sprayer of claim 2, wherein said air cylinder has an inward projection at the lower end portion thereof, and said air cylinder plunger has an outward projection at the upper end portion thereof, thereby to prevent the air cylinder plunger from disengaging from the air cylinder.

4. The manually-operated sprayer of claim 1, wherein said air cylinder has an inward projection at the lower end portion thereof, and said air cylinder plunger has an outward projection at the upper end portion thereof, thereby to prevent the air cylinder plunger from disengaging from the air cylinder.

* * * * *